US007017383B2

(12) United States Patent
de Sousa Monteiro

(10) Patent No.: US 7,017,383 B2
(45) Date of Patent: Mar. 28, 2006

(54) PRESS TRANSFER SYSTEM MOUNTING AND METHOD

(76) Inventor: Luciano Trindade de Sousa Monteiro, Rua Maranhao, 680 apt. 121, Sao Caetano do Sul - SP (BR) 09541-001

( * ) Notice: Subject to any disclaimer, the term of this patent is extended or adjusted under 35 U.S.C. 154(b) by 14 days.

(21) Appl. No.: 10/833,336

(22) Filed: Apr. 27, 2004

(65) Prior Publication Data

US 2005/0235727 A1 Oct. 27, 2005

(30) Foreign Application Priority Data

Apr. 27, 2003 (BR) ..... 0305689

(51) Int. Cl.
*B21D 43/05* (2006.01)

(52) U.S. Cl. ..... 72/405.09; 72/405.01; 198/621.1

(58) Field of Classification Search ..... 72/405.01, 72/405.09, 405.1, 405.15; 198/621.1
See application file for complete search history.

(56) References Cited

U.S. PATENT DOCUMENTS 4,589,819 A * 5/1986 Shirao ..... 198/468.4
5,140,839 A * 8/1992 Bruns ..... 72/405.1
5,390,525 A * 2/1995 Fisch ..... 72/405.02
5,701,781 A * 12/1997 Giles ..... 72/405.12
5,992,209 A * 11/1999 Hofele et al. ..... 72/405.1

* cited by examiner

*Primary Examiner*—Daniel C. Crane
(74) *Attorney, Agent, or Firm*—John R. Benefiel

(57) ABSTRACT

A mounting and method for a multistation stamping press part transfer system in which transfer drive modules are mounted to pivotal supports so that rail-gripper assemblies connected to pairs of modules can be oriented to transfer blanks/parts through the press in either of two orthogonal directions.

7 Claims, 5 Drawing Sheets

FIG - 10
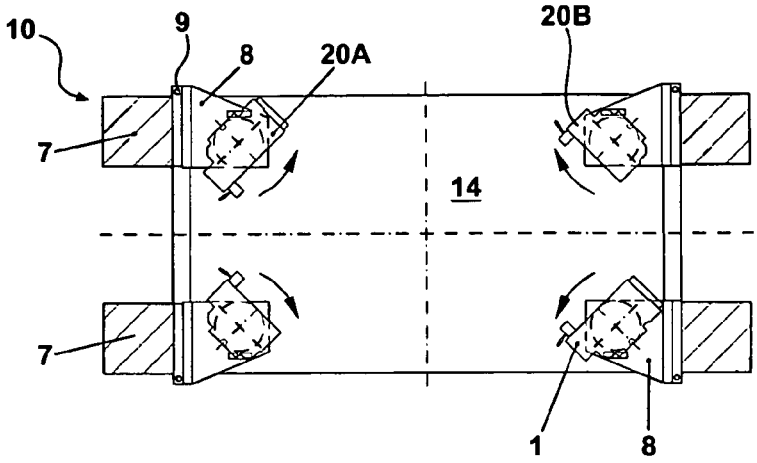
FIG - 11
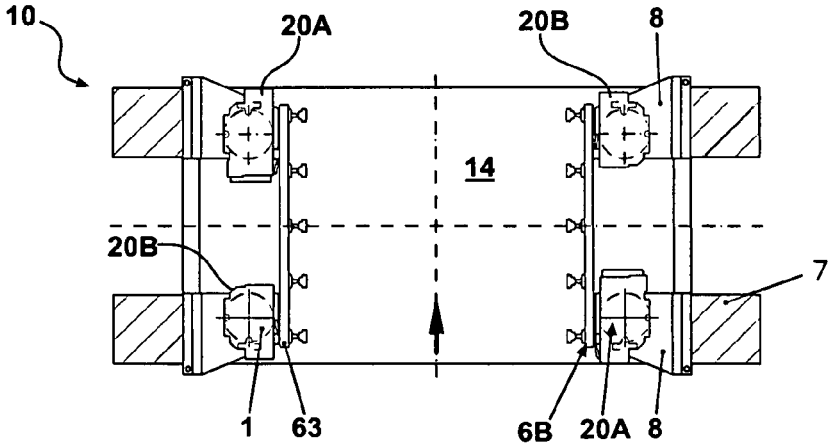
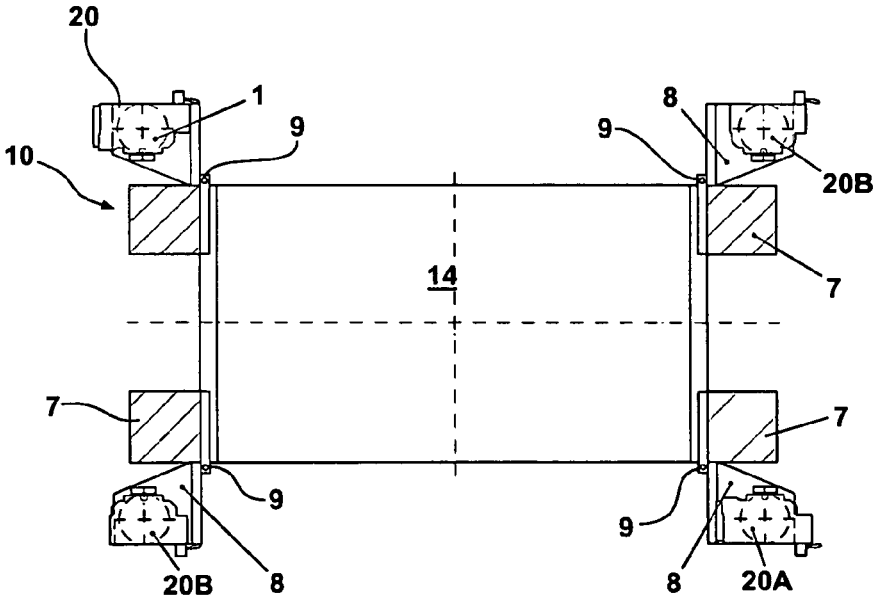
FIG - 12

PRESS TRANSFER SYSTEM MOUNTING AND METHOD

BACKGROUND OF THE INVENTION

This invention concerns part transfer systems such as are used in multistation stamping presses, in which blanks or partially formed parts which are to be operated on in a press are moved step by step sequentially along a series of stations within a working area of the press where successive forming steps are executed by die sets installed in the press.

The working area of most presses is rectangular, having a greater width or greater length. It may be advantageous to move blanks of differing proportions through the press in one direction or the other with respect to the work area to better take advantage of the space available in the working area of the press.

It is usual to orient rail-gripper assemblies of the transfer system in either of two directions of blank/part transfer relative to the press, i.e., either lengthwise or transversely of the press working area. The transfer systems are mounted for a specific part transfer direction through the working area.

It is the object of the present invention to provide a mounting and method for a transfer system which conveniently allows for rapid installation of a part transfer system in either a lengthwise or transverse direction relative the press working area.

SUMMARY OF THE INVENTION

The above object and others which will become apparent upon a reading of the following specification and claims are achieved by mounting transfer drive modules on a pivotal support at each corner of the press working area, each pivotal support having a base fixedly mounted to a plate on the press bolster or on brackets fixed to the columns of the press. The modules are each supported thereon to be rotatable in either of two rotated positions, so that when rail-gripper assemblies are connected to pairs of the modules they extend in either a longitudinal or transverse direction through the press working area. A locking device locates and fixes the pivotal supports in either of the two 90° rotated positions.

The rail-gripper assembly of the transfer system are each connected at each end to one of the modules. The connection of the modules to the rail-gripper assembly in either rotated position of the pivot supports selectively allows either a lengthwise or transverse direction of blank/part transfer movement through the press.

DESCRIPTION OF THE DRAWINGS

FIG. 10 is the same view as FIG. 9 but with the rail-gripper assemblies removed and the modules partially pivoted.

FIG. 11 is the same view as FIG. 10 but with the transfer drive modules fully pivoted and rail-gripper assemblies installed for a transverse direction of part transfer movement, indicated by an arrow.

FIG. 12 is the same view as FIG. 11 but with the rail-gripper assemblies removed and the transfer drive modules swung out of the way for die replacement clearance.

DETAILED DESCRIPTION

Figure 1:
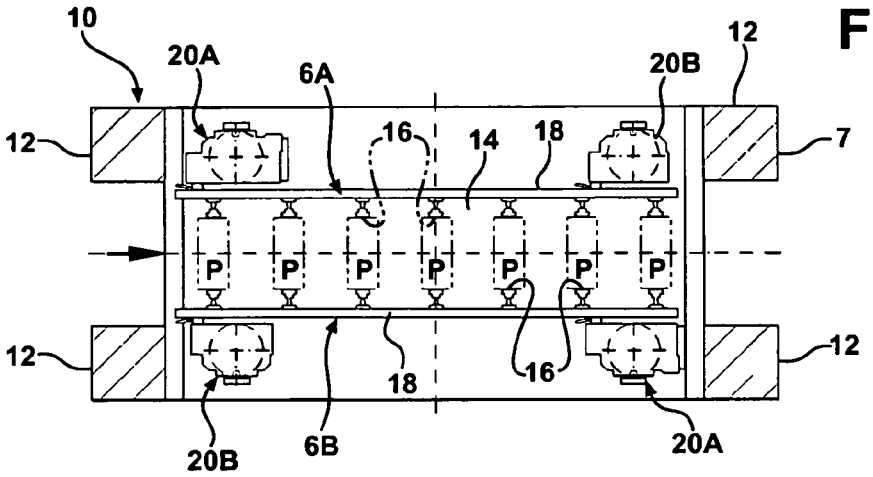
FIG. 1 is a plan view of a horizontal section taken through a press showing the press working area having a set of four pivot supports and four transfer drive modules installed thereon, with the rail-gripper assemblies extending to provide a longitudinal direction of part transfer movement.
Figure 2:
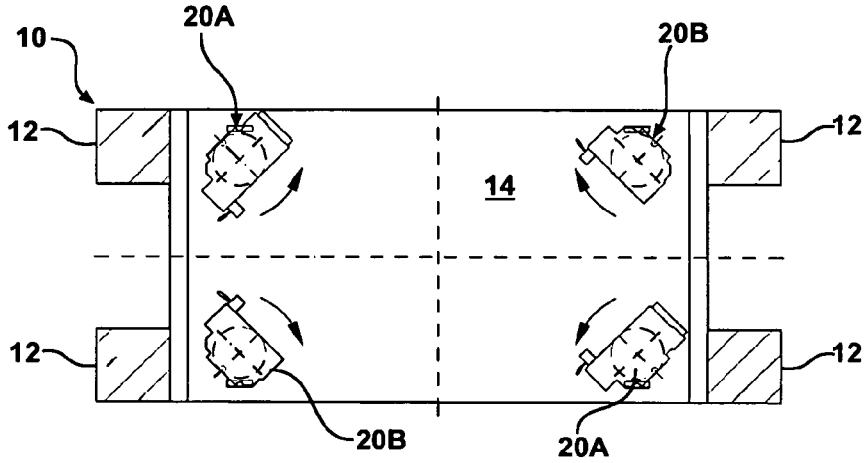
FIG. 2 is the same view as FIG. 1 but with the rail-gripper assemblies removed and the transfer drive modules partially turned to a 90° rotated position necessary for a transverse direction of transfer movement.
Figure 3:
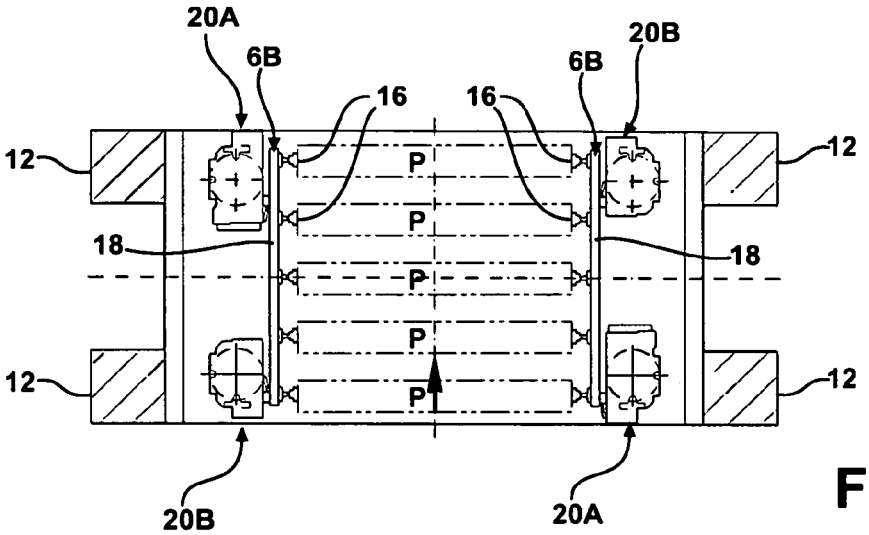
FIG. 3 is the same view as FIG. 1 but with the modules completely turned 90° for the transverse direction of movement indicated by an arrow, with another set of rail-gripper assemblies installed on the modules.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The present invention is concerned with mounting blank or part transfer components in a press so as to be able to be readily oriented in either of two directions with respect to the press working area.

The part transfer mechanisms are utilized in stamping presses and similar metal working equipment for moving the parts through the press, through several stations for successive operations on the blank/part partially formed.

Such systems typically include a pair of elongated rail-gripper assemblies including a pair of parallel spaced apart rail members and a series of grippers arranged along each rail, with aligned opposed pairs of grippers each adapted to grasp either end of a blank or partially formed part. The series of parts are then indexed to the succeeding stations by motion of the rails in being driven by the transfer drive modules.

Three modes of rail motion are typically involved in the part transfer through in a stamping press, a vertical up and down motion, a linear advance and retract motion, and in-and-out motion in which the rails are brought together and then moved apart.

The rails are first moved together with the rails in a retracted and lowered position to bring each set of opposed pairs of grippers into engagement with a blank or partially formed part in each of the respective stations.

The grippers are actuated to grip the part and the rails are then elevated to lift the part to clear the die contours, moved linearly forward to index all of the blanks/parts into the next station, and then lowered to deposit the blank/parts in the next succeeding station, the gripper sets releasing the blanks/parts at that time. The rails then are moved apart as the dies are moved down by the upper press platen, and thereafter retracted to the retracted, lowered return position.

U.S. Pat. No. 4,875,931 naming the present inventor, which is hereby incorporated by reference, describes in detail such a three motion drive transfer mechanism for driving the rail-gripper assemblies using these three modes of motion. See also U.S. Pat. No. 5,941,119, naming the present inventor, which is hereby incorporated by reference, also describing such a transfer drive mechanism.

Reference is also made to Brazilian Patent 8701725 hereby incorporated by reference, which describes a gripper closing motion in such a transfer mechanism.

A transfer mechanism of this type has its rail-gripper assemblies typically mounted in one of two different orientations with respect to the rectangular press working area, i.e., longitudinally along the long dimension of the press working area or transversely across the press working area.

As mentioned above, in the past, transfer drive mechanisms were mounted for part transfer movement either in one or the other direction, and the press transfer mechanism was dedicated to either particular orientation.

The present invention is concerned with the mounting of pairs of the transfer drive modules so as to be able to easily orient the rail-gripper assemblies and thus be able to produce part transfer movement in either a lengthwise or transverse direction through the press working area.

The present invention is not in the design of the transfer modules per se, as these are now known in the art, and thus these modules are not described here in detail.

FIG. 1 shows a section taken through a press 10 having four posts or columns 12. The two spaced apart elongated rail-gripper assemblies 6 are oriented longitudinally, extending through the rectangular press working area 14 in the direction as indicated by the arrow, i.e., the longer dimension of the press working area 14.

The rail-gripper assemblies 6A, 6B each include an elongated rail 18 and a series of part grippers 16 of conventional design spaced apart along the length of the rail 18.

The part grippers 16 on each rail 18 are arranged in opposed pairs, each pair comprised of the aligned part grippers 16 along the respective rails 18. A blank or partially formed part P is typically gripped on each end by each gripper pair, which correspond to a station in the press 10.

Figure 4:
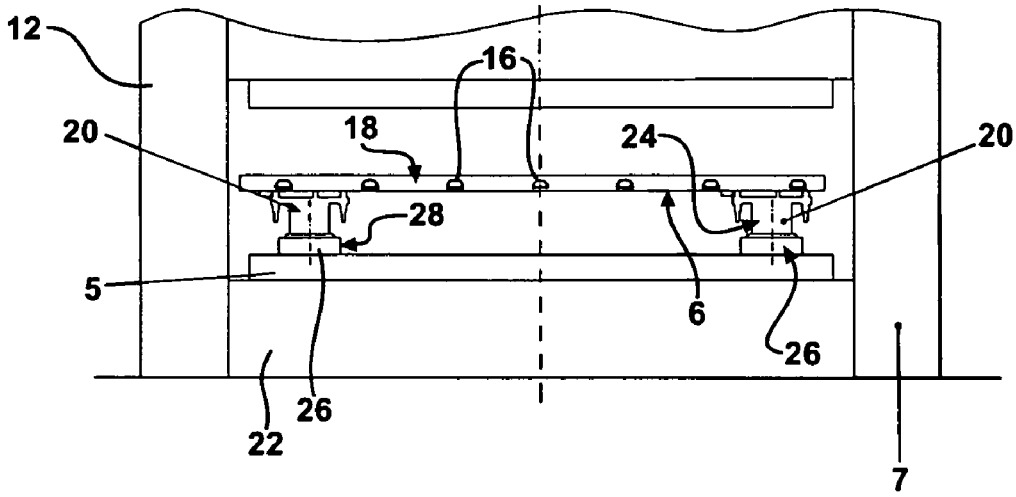
FIG. 4 is a front elevational view of a press having the upper part thereof broken away and having part transfer modules oriented therein for part transfer in a longitudinal direction.
Figure 5:
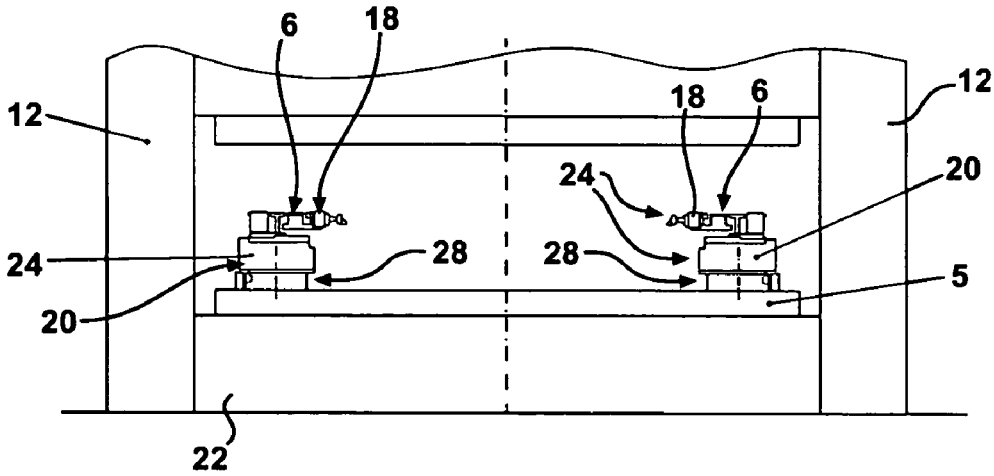
FIG. 5 is the same view as FIG. 4 but with the rail-gripper assemblies removed and the transfer drive modules rotated to enable a transverse direction of transfer within the press.
Figure 6:
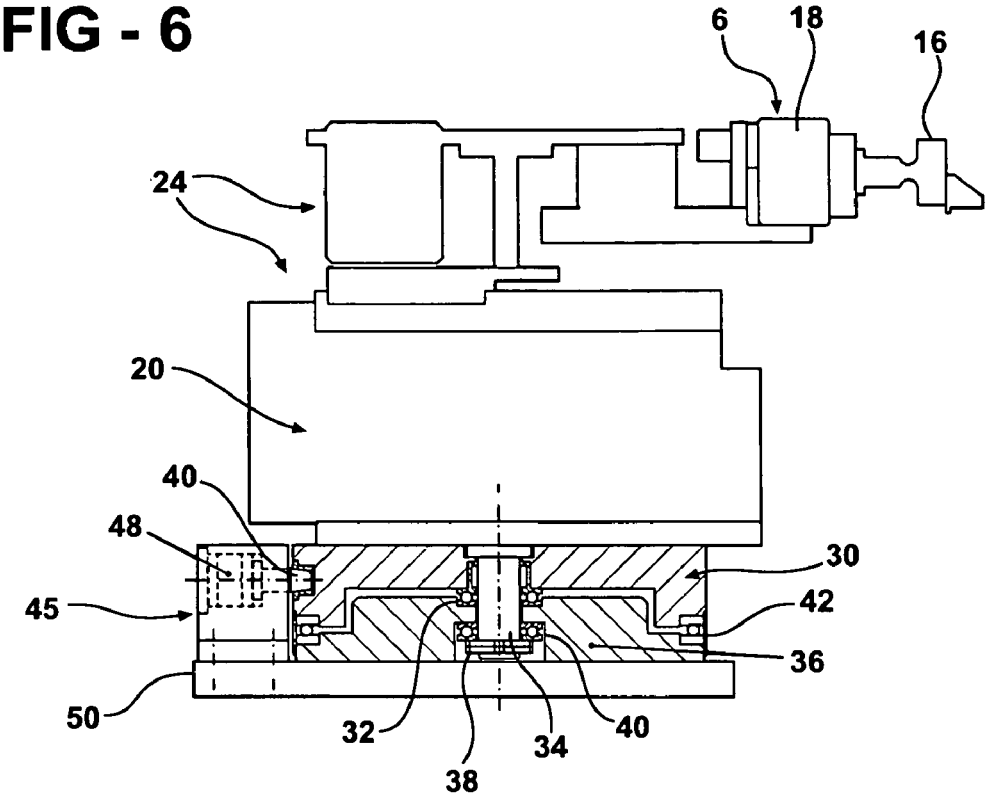
FIG. 6 is an enlarged elevational view of a pivotal support in partial section and a transfer drive module.
Figure 7:
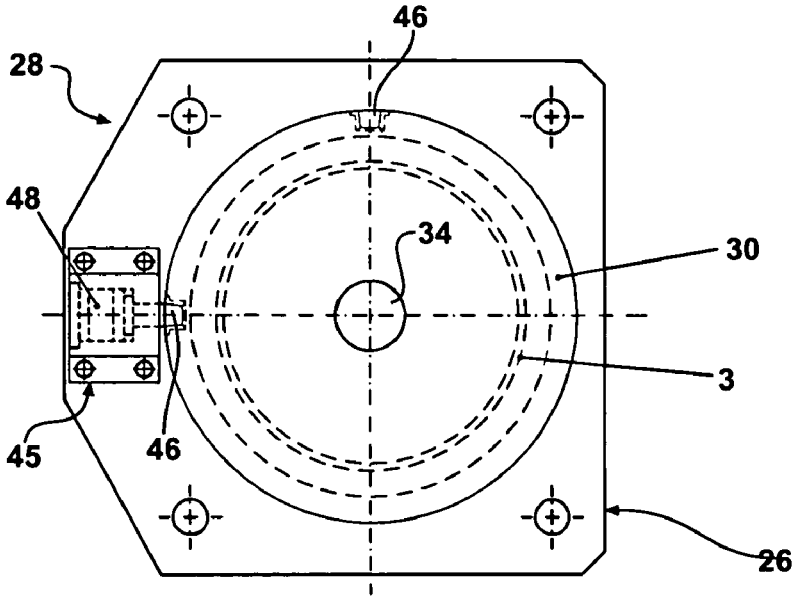
FIG. 7 is a top view of the pivotal support shown in FIG. 6.
Figure 8:
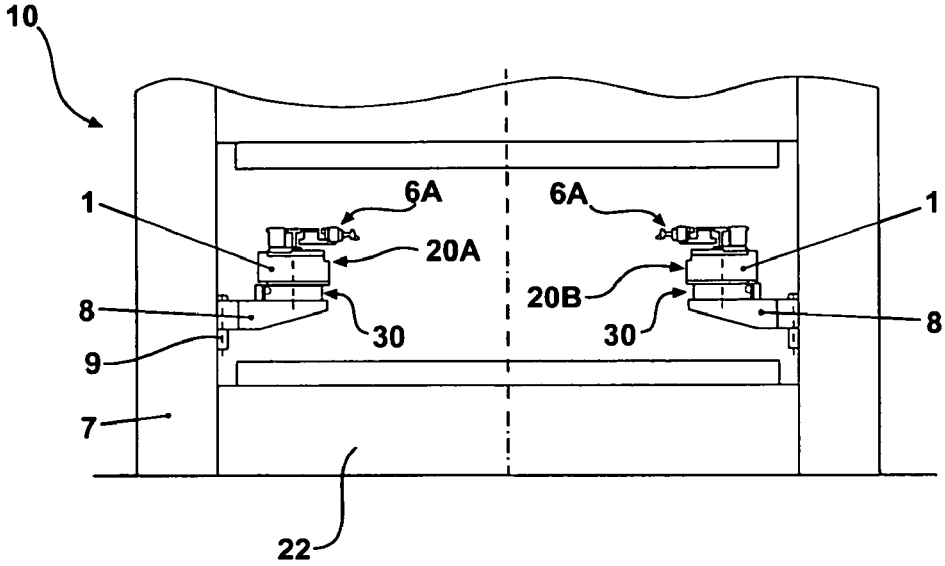
FIG. 8 is a front elevational view of a press with the top broken away having a set of transfer drive modules and pivotal supports mounted on brackets attached to the press columns, oriented to position the modules and rail-gripper assemblies for transverse transfer movement of parts through the press.
Figure 9:
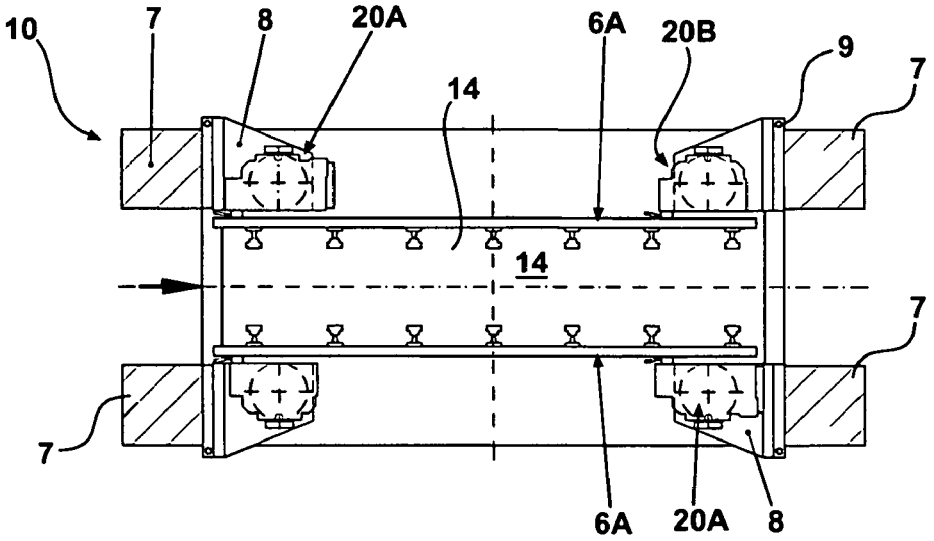
FIG. 9 is a plan view of a press in partial section having a set of transfer drive modules and rail-gripper assemblies shown oriented for longitudinal transfer movement.

A set of four transfer drive modules 20A, 20B are mounted (FIG. 4) on the press lower platen or bolster 22, each module 20A, 20B located adjacent a respective one of the four press columns 12.

The transfer drive modules 20A, 20B typically contain complementary drive components, i.e., only the drive modules 20A may include X-axis drive components while modules 20B may contain X and Z axis drive components. According to the present invention, the complementary modules 20A and 20B are located diagonally across from each other in the press working area. This is so that each type of module 20A and 20B have a complementary module 20B or 20A located directly across from it, for the purpose described below.

The modules 20A, 20B are each pivotally mounted on a pivotal support 26 fixed to a plate 5 installed atop the press lower platen or bolster 22 after the pivotal supports 26 and modules 20A, 20B have been mounted thereto. For convenience, plate 5 may be mounted to be rolled in and out of the press 10 and clamped in position when in the press 10.

The rail-gripper assemblies 6A, 6B are each mounted at their ends to the respective one of a pair of transfer drive modules 20A, 20B on each side of the press working area 14 each module 20A, 20B located at a corner of the working area 14.

The transfer drive modules 20A, 20B each include various servo motors, cams, and other components to execute the three modes of transfer motion of the gripper-rail assemblies 6A, 6B, as well as to operate the grippers 16 in synchronized fashion. The various module components are here indicated on in outline form at 24. Since such components are now known in the art and examples described in the above referenced patents, the modules 20A, 20B are not here described in detail.

A pivotal support 28 for each module 20A, 20B includes a revolving platform 30 having the part transfer drive module 20A, 20B attached to the top thereof. The platform 30 is rotatable on an inner antifriction bearing 32 surrounding a central stub shaft 34 and recessed into a base member 36. A flange 38 on the shaft 34 captures a second inner antifriction bearing 40 located in another recess in the base member 36. This second inner bearing 40 resists lifting of the platform 30.

An outer antifriction bearing 42 is interposed between the rim of the platform 30 and the base member 36 so as to provide a very stable support for each module 20A, 20B.

A tapered locking pin 44 included in a locking pin assembly 45 is selectively engaged or retracted from a pair of pockets 46 each located in the rim of the platform 30 at a respective rotated position of the platform 30 to locate and secure the same in either rotated position. This can be carried out by a suitable pneumatic or electrical actuator 48 or manually. The base 36 can be integrally connected to a base plate 50, which also mounts the locking pin assembly 45.

FIGS. 8–12 show an alternative mounting of the pivotal supports 26 for the modules 20A, 20B.

Brackets 8 are mounted to each of the four press columns 12 above the bolster 22 projecting towards an opposing bracket S and over the press working area 14 and bolster 22. The pivotal supports 26 are each mounted on a respective bracket 8 to allow the modules 20A, 20B to be oriented in either of two rotated positions, as in the above described embodiment This allows installation of rail-gripper assemblies 6A, 6B in either a longitudinal direction (FIG. 9) or transverse direction (FIG. 11) as before, by pivoting of the modules 20A, 20B on the pivoted supports 30.

However, in this embodiment, the brackets 8 themselves are hinged on pins 9 to be able to be swung out behind a respective column 12 to allow free access to the press working area 14, enabling convenient die changes or other activities to be carried out without complete removal of the brackets 8. The brackets 8 are normally fixedly mounted to a respective column 12 by suitable screws, locking pins, or other attachments which are removed in preparation for swinging the brackets 8 out of the way.

The invention claimed is:

1. A blank/part transfer system in combination with a press having a generally rectangular horizontal working area over a press bolster, said working area defined between four press columns, including a pair of elongated rail-gripper assemblies spaced apart and extending parallel to each other across said working area and above said press bolster; a pair of transfer drive modules connected to each of said rail-gripper assemblies, each module in each pair connected to a respective end of an associated elongated rail-gripper assembly;

a pivotal support for each transfer drive module at a respective corner of said press working area enabling rotation of each transfer drive module between selective rotated positions and mounting of said pair of rail-gripper assemblies thereto to alternatively extend in either a lengthwise or transverse horizontal directions with respect to said press working area which are normal to each other when connected at either end to a respective one of said transfer drive modules in each pair of said transfer drive modules.

2. The combination according to claim 1 wherein said pivot supports each include a lock to locate and secure each of said pivotal supports in their respective rotated positions.

3. The combination according to claim 1 wherein each of said pivotal supports are mounted on a base plate adapted to be installed on said press bolster.

4. The combination according to claim 1 wherein each pivotal support is fixed on a bracket mounted to a respective column of said press spaced above said press bolster.

5. The combination according to claim 4 wherein each of said brackets is mounted to said respective press column by a pivot so as to be swingable out and away from said press working area to enable free access thereto.

6. The combination according to claim 1 wherein said modules connected to each end of each rail-gripper assemblies are complementarily configured with respect to each other, and matching modules in each pair are located diagonally across from each other over said press working area.

7. In a forming press, a method of mounting a pair of elongated rail-gripper assemblies to extend across a rectangular working area of said forming press and move in alternative directions and on respective pairs of transfer drive modules therein, each module in each pair connected to a respective end of a respective elongated rail-gripper assembly comprising:

mounting each transfer drive module on a respective pivotal support located at a respective corner of said press working area for each transfer drive module with each transfer drive module to face another one of said transfer drive modules aligned therewith in a lengthwise direction in a first position on said pivot support and mounting said elongated rail-gripper assemblies between said facing transfer drive modules;

and rotating said pivot supports after removal of said elongated rail-gripper assemblies from said transfer module to reorient said rail-gripper assemblies in a transverse direction across said press working area after installing each of said elongated rail-gripper assemblies to respective facing pairs of transfer modules.

* * * * *